US006419371B1

(12) United States Patent
McCalla et al.

(10) Patent No.: US 6,419,371 B1
(45) **Date of Patent: *Jul. 16, 2002**

(54) LIGHTED TOOL

(75) Inventors: Gavin McCalla; William R. Lutz, both of Cumming, GA (US)

(73) Assignee: Ovation Group, Inc., Alpharetta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/483,710

(22) Filed: Jan. 14, 2000

Related U.S. Application Data

(63) Continuation-in-part of application No. 09/069,549, filed on Apr. 29, 1998, now Pat. No. 6,030,002.

(51) Int. Cl.[7] ..... B25B 23/18

(52) U.S. Cl. ..... 362/119; 362/120; 362/190; 362/191; 362/399; 362/109; 362/253

(58) Field of Search ..... 362/119, 120, 362/190, 191, 399, 109, 253

(56) References Cited

U.S. PATENT DOCUMENTS

| | | | |
|---|---|---|---|
| 1,144,210 A | 6/1915 | Kincaid | |
| 1,253,769 A | 1/1918 | Anderson | |
| 1,439,404 A | 12/1922 | Cotharin | 240/6.46 |
| 1,603,985 A | 10/1926 | Rosenberg | |
| 1,635,933 A | 7/1927 | Genoves | |
| 2,242,536 A | 5/1941 | Montgomery | 240/6.46 |
| 2,288,093 A | 6/1942 | Kaffenberger et al. | 240/6.46 |
| 2,341,375 A | 2/1944 | Hambleton | 240/6.46 |
| 2,466,342 A | 4/1949 | Watts | 240/6.46 |

(List continued on next page.)

FOREIGN PATENT DOCUMENTS

| | | |
|---|---|---|
| EP | 0 306 461 A1 | 3/1989 |
| EP | 0 421 721 A2 | 10/1991 |
| GB | 2 031 316 B | 11/1982 |
| GB | 2 053 438 B | 4/1983 |
| GB | 2 272 967 | 6/1996 |
| TW | 86216028 | 9/1997 |

OTHER PUBLICATIONS

Serial No. 09/441,841 dated Nov. 17, 1999. Co–pending Application to sam Applicant (claims only; specification same as parent U.S. Patent No. 6,030,092 attached thereto).

Serial No. 09/636,366 dated Aug. 11, 2000. Co–pending Application to same Applicant.

Serial No. 29/127,772 dated Aug, 11, 2000. Co–pending Application to same Applicant.

Serial No. 29/127,773 dated Aug. 11, 2000. Co–pending Application to same Applicant.

*Primary Examiner*—Sandra O'Shea
*Assistant Examiner*—Ali Alavi
(74) *Attorney, Agent, or Firm*—Needle & Rosenberg, P.C.

(57) ABSTRACT

A lighted tool including a handle member, which has a distal end adapted to engage a blade member or other implement. A light module has a light source capable of producing a beam of light and the light module is of a size to be complementarily received within the bore of the handle member so that the light source illuminates the blade member engaged with the distal end of the handle member. The light module is preferably detachably secured within the bore of the handle member, such as by complementarily threaded surfaces, so that the light module is insertable into the bore and removable therefrom. Thus, the light module can be either used to illuminate the blade member and work piece when disposed within the bore of the handle member or used independently as a conventional flash light.

22 Claims, 3 Drawing Sheets

U.S. PATENT DOCUMENTS

| | | | | |
|---|---|---|---|---|
| 2,706,769 | A | 4/1955 | Cook | 240/6.46 |
| 2,736,792 | A | 2/1956 | Freeland | 240/6.46 |
| 2,773,974 | A | 12/1956 | Markett | 240/6.46 |
| 2,783,364 | A | 2/1957 | Wood, Jr. | 240/6.46 |
| D182,397 | S | 4/1958 | Blum | |
| D197,757 | S | 3/1964 | Nagamori | D93/4 |
| 3,185,832 | A | 5/1965 | Nagamori | 240/6.46 |
| 3,603,782 | A | 9/1971 | Wortmann | 240/6.46 |
| 3,919,541 | A | 11/1975 | Chao | 240/6.46 |
| 4,283,757 | A | 8/1981 | Nalbandian et al. | 362/120 |
| 4,669,186 | A | 6/1987 | Liu | |
| D295,011 | S | 4/1988 | Herron et al. | D7/151 |
| 4,768,137 | A | 8/1988 | Hwaw et al. | 362/120 |
| 4,936,171 | A | 6/1990 | Berg | 81/451 |
| D323,449 | S | 1/1992 | Corona et al. | D8/83 |
| 5,124,893 | A | 6/1992 | Jeng | 362/120 |
| D327,827 | S | 7/1992 | Kwan | D8/61 |
| D328,699 | S | 8/1992 | Shaanan et al. | D8/82 |
| D329,185 | S | 9/1992 | Hasegawa | |
| D330,497 | S | 10/1992 | Hsin | D8/68 |
| D331,356 | S | 12/1992 | Amsberry | D8/68 |
| D333,239 | S | 2/1993 | Pogue | |
| 5,211,468 | A | 5/1993 | Jeng | 362/120 |
| D340,633 | S | 10/1993 | Badiali | D8/85 |
| 5,265,504 | A | 11/1993 | Fruhm | 81/439 |
| 5,313,376 | A * | 5/1994 | McIntosh | 362/119 |
| 5,369,555 | A | 11/1994 | McKain et al. | 362/120 |
| D358,316 | S | 5/1995 | Markwart et al. | D8/82 |
| D359,789 | S | 6/1995 | Seber et al. | |
| D363,012 | S | 10/1995 | Humphries | D8/87 |
| D364,694 | S | 11/1995 | Silvia | D26/38 |
| 5,473,519 | A | 12/1995 | McCallops et al. | 362/120 |
| 5,510,962 | A | 4/1996 | Hsiao | 362/120 |
| 5,515,249 | A | 5/1996 | Shiao | 362/119 |
| 5,550,719 | A | 8/1996 | Kuo | 362/120 |
| D375,243 | S | 11/1996 | Hasegawa | |
| 5,577,829 | A | 11/1996 | Hall | 362/119 |
| D376,305 | S | 12/1996 | Kung | D8/82 |
| 5,584,565 | A | 12/1996 | Berg | 362/120 |
| 5,628,556 | A | 5/1997 | Hrabar et al. | 362/119 |
| D383,660 | S | 9/1997 | Anderson | D8/83 |
| 5,713,656 | A | 2/1998 | Lin | 362/120 |
| 5,727,319 | A | 3/1998 | Myerchin et al. | |
| D401,130 | S | 11/1998 | Maier et al. | D8/87 |
| D408,256 | S | 4/1999 | Maxcy | |
| D412,096 | S | 7/1999 | Kung et al. | D8/87 |
| D412,355 | S | 7/1999 | Saetherbo | |
| D417,130 | S | 11/1999 | Hollinger | |
| D420,269 | S | 2/2000 | Ben-Moshe | |
| 6,135,608 | A | 10/2000 | Lin | |

* cited by examiner

LIGHTED TOOL

RELATED U.S. APPLICATION DATA

This application is a Continuation-in-Part of Ser. No. 09/069,549, filed on Apr. 29, 1998 now U.S. Pat. No. 6,030,092, the status of which is still pending.

BACKGROUND OF THE INVENTION

1. Field of the Invention

The present invention relates to a lighted tool, and in the preferred embodiment a lighted knife that provides illumination of its own blade or a work piece. The lighted knife includes a blade member, a handle member, and a light module disposed within a portion of the handle member.

2. Background Art

The present invention provides a solution to the problem of working in a poorly-lit environment. For example, sportsmen such as campers, hunters and fishermen often are required to work or cook in poorly lit conditions, such as after sunset or inside unlit cabins or tents. Often, in wilderness or other outdoor conditions, no ready source of electricity exists to power conventional lighting equipment. Further, use of a separate conventional flashlight is often impractical or impossible.

Additionally, automobile, industrial and other mechanical or electrical components are often located inside of unlit enclosures or in areas that block external background light. This problem is particularly troublesome for industrial equipment that is located next to other components that can easily be damaged or that present a hazard to the technician, such as exposed high-voltage sources.

One prior art solution to this problem is a trouble light, which the user hangs in a position to illuminate the tools and work surface or work piece. The light may be battery powered or connected to an outlet by an extension cord. One obvious problem with this solution is that the more common electrically powered version requires that an electrical outlet or other power source be located near the work area. Additionally, a trouble light is a separate component which may be bulky, and must be carried by the user to the work area. Thus, such separate lights are impractical for many outdoor and industrial uses.

Another solution for industrial applications is the development of tools that generate their own light, instead of using separate lighting. The advantage of this approach is that a beam of light is generated by the tool itself, and is directed at the area where the user is performing the work. Thus, the lighted tools can be used to manipulate nuts, bolts, screws and other fasteners in the poorly-lighted environments using light produced by the tool itself. One example of this solution is disclosed in U.S. Pat. No. 2,242,536, which issued to Montgomery in 1941. More recent examples of similar tools are disclosed in U.S. Pat. Nos. 5,577,829 to Hall and 5,628,556 to Hrabar et al. The lighted tools have been found to be more advantageous than other prior art techniques.

However, a need still exists in both industrial applications and outdoor applications for other lighted tools and implements having a light source which is removable from the tool and that can be used independently as a flashlight.

SUMMARY OF THE INVENTION

The present invention satisfies this and other needs in the art and comprises a handle member and a light module, or a flashlight, for illuminating a portion of the handle member. The handle member has a distal end to which a blade member is connected in the preferred embodiment. The handle member also defines a bore longitudinally extending along at least a portion of the length. In some embodiments, the bore is co-extensive with the length of the handle member, such that the first end of the bore creates an aperture through the distal end of the handle member. In such embodiments, a light module installed within the bore may communicate light directly through the aperture to the blade member and work area. In other embodiments, the length of the handle member is greater than the length of the bore. In those embodiments, a portion of the handle member between the bore and the distal end of the handle member is optically conductive so that light can traverse therethrough.

The light module or other illumination means having a light source is removably inserted into the bore of the handle member. The light module is of a size to be complementarily received within the bore so that the light source is disposed within the bore adjacent the distal end of the handle member. When the light source is energized, the light emitted therefrom illuminates the blade member and/or the intended work piece. The light module can also be removed from the bore and used independently of the handle member.

A means for detachably securing the light module within the bore of the handle member allows the light module to be freely inserted into the bore for use of the tool and removed therefrom to be used as a flashlight. The preferred detachably securing means comprises a portion of the light module and a portion of the bore defining complementarily threaded surfaces. This detachably securing means provides a waterproof connection between the handle member and the light module and prevents accidental disengagement of the two components. However, the present invention also contemplates a design in which the light source is integrally formed within the handle member.

The present invention additionally includes a method for illuminating the blade member that extends longitudinally from the distal end of the handle member. The method comprises the steps of first detachably inserting a light source into the bore of the handle member and then detachably securing the light source within the bore. The light source is energized to produce a light through the transparent portion of the handle member and onto the blade member and/or work piece.

These and other features of the present invention will become more fully apparent from the following description and accompanying drawings.

DETAILED DESCRIPTION OF THE INVENTION

Figure 1:
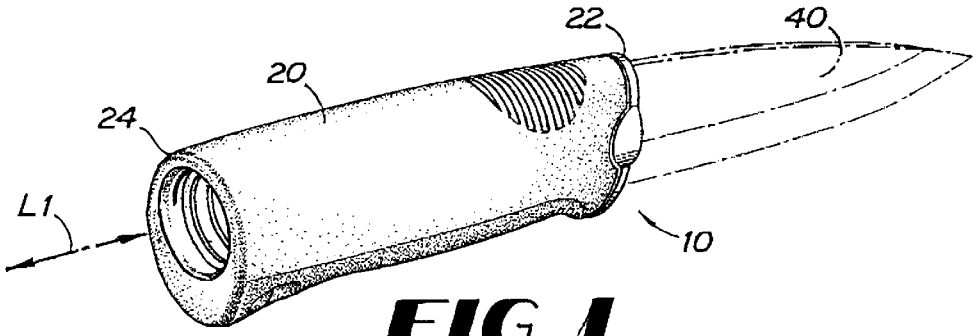
FIG. 1 is a rear perspective view of a first embodiment of the present invention.

The present invention is more particularly described in the following examples that are intended as illustrative only since numerous modifications and variations therein will be apparent to those skilled in the art. As used in the specification and in the claims, "a," "an," and "the" can mean one or more, depending upon the context in which it is used. The preferred embodiment is now described with reference to the figures, in which like numbers indicate like parts throughout the figures.

Referring generally to FIGS. 1–9, the present invention as illustrated encompasses a lighted knife 10 comprising a handle member 20 and a means for illuminating a portion of the handle member 20. The handle member 20 has a distal end 22, a proximal end 24, a longitudinal axis L1, and a length extending between the proximal and distal ends 22, 24. The handle member 20 also defines a bore 26 longitudinally extending along at least a portion of the length between the proximal and distal ends 22, 24, in which the bore 26 has a first end 28 and an opposite second end 29. The second end 29 is located adjacent the proximal end 24 of the handle member 20. The bore 26 also forms an interior surface 30 of the handle member 20.

In one embodiment, a portion of the handle member 20 is optically conductive between the first end 28 of the bore 26 and the distal end 22 so that light can traverse therethrough. For example, the optically conductive portion 32 of the handle member 20 may be formed of a clear material, such as a hardened plastic or other similar polymer. Thus, in such an embodiment, light traverses through the clear plastic that forms the optically conductive portion 32 of the handle member 20. The remaining portion of the handle member 20 between the first end 28 of the bore 26 and the proximal end 24 may be constructed of the same or similar optically conductive material. Alternatively, remaining portion of the handle member 20 may be constructed of a different material than that used to construct the optically conductive portion 32, such as an opaque material.

In another embodiment, the handle member 20 can be partially or substantially formed of an elastomeric material, instead of the clear material discussed above. For example, the plastic handle member 20 can be over-molded so that the elastomeric material covers its surface. Alternatively, the majority of the handle member 20 can be formed of the elastomeric material, with the exception of the optically conductive portion 32 of the handle member 20.

Figure 6:
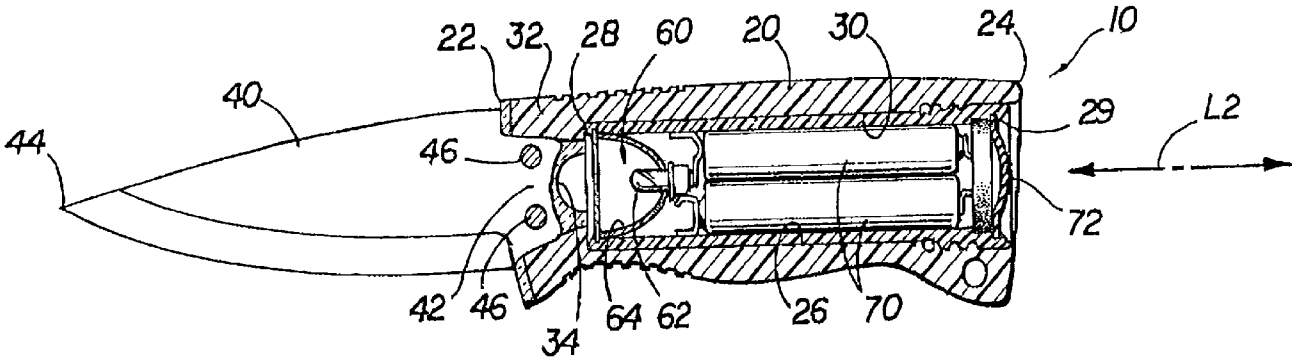
FIG. 6 is a cross-sectional view along line 6—6 in FIG. 3.

As shown best in FIG. 6, the bore 26 can also include a dome 34 molded into its first end 28 that enhances the propagation of light toward the distal end 22 of the handle member 20. Other materials, such as fiber optics (not shown), can be used within the handle member 20 to direct better light through the optically conductive portion 32 of the handle member 20.

A portion of the distal end 22 of the handle member 20 engages one blade member 40. Blade members 40 may be utilized in shapes including, for example, a straight "camper's blade," (shown in FIGS. 1–6), a narrower "fisherman's fillet blade" (shown in FIG. 8), a notched "hunter's blade" (shown in FIG. 9) or a "Bowie knife blade" (shown in FIG. 7). In one embodiment, the blade member 40 has a rear end 42 and an opposed tip end 44. The rear end 42 of the selected blade member 40 may be formed into the material of the handle member 20 and fixedly engaged thereby, as shown best in FIG. 6. In such an embodiment, at least 0.8 inches of the rear end 42 of the blade member 40 is preferably disposed and held within the material, such as clear plastic, forming the distal end 22 of the handle member 20. Thus, as shown in FIG. 6, the distal end 22 of the handle member 20 securably holds the rear end 42 of the blade member 40 so that the blade member 40 cannot move relative to the handle member 20.

As defined in this specification and the appended claims, the terms "engaged" and "engage," when used in reference to the interface between the rear end 42 of the blade member 40 and the distal end 22 of the handle member 20, refer to a plurality of embodiments of the lighted tool 10. For example, as described herein, the blade member 40 may be fixedly engaged within the distal end 22 of the handle member 20. Alternatively, the blade member 40 may be detachably engaged within the distal end 22 of the handle member 20.

In one embodiment, the rear end 42 of the blade member 40 defines one or more cutouts 46 passing therethrough. The cutouts 46 provide increased strength and structural stability to the handle member 20 and to the lighted tool 10 generally, as the material from which the handle member 20 is manufactured may be permitted to flow through the cutouts 46 and harden therein, providing a mechanical anchor that fixedly engages the rear end 42 of the blade member 40, and provides added torsional stability and strength to the handle member 20.

The handle member 20 may also be adapted so that any of a plurality of blade members 40 may be detachably engaged with the distal end 22 of the handle member 20 so that the lighted knife 10 can perform multiple functions. Such interchangeability may be accomplished in a variety of ways. For example, one or more removable pins (not shown) may be utilized to removably anchor interchangeable blade members 40 within the handle member 20. In such an embodiment, the handle member 20 and rear end 42 of the blade member 40 may define one or more holes therethrough, such that when the rear end 42 of a selected blade 40 member is inserted into the distal end 22 of the handle member 20, the holes through the rear end 42 of the blade member 40 and the distal end 22 of the handle member 20 are substantially aligned, defining an aperture through the lighted tool 10. The blade member 40 may then be removably coupled to the handle member 20 by inserting a complementarily shaped pin into each of the one or more apertures. The pin may be sized to provide a slight interference fit when inserted into the aperture, such that friction between the pin and the interior surface of the aperture provides resistance to disengagement of the pin.

Although not shown, another contemplated embodiment of the lighted knife includes the blade member being pivotally mounted to the handle member. In this embodiment, the handle member and blade member may be folded together and closed, like a "pocket knife."

Figure 7:
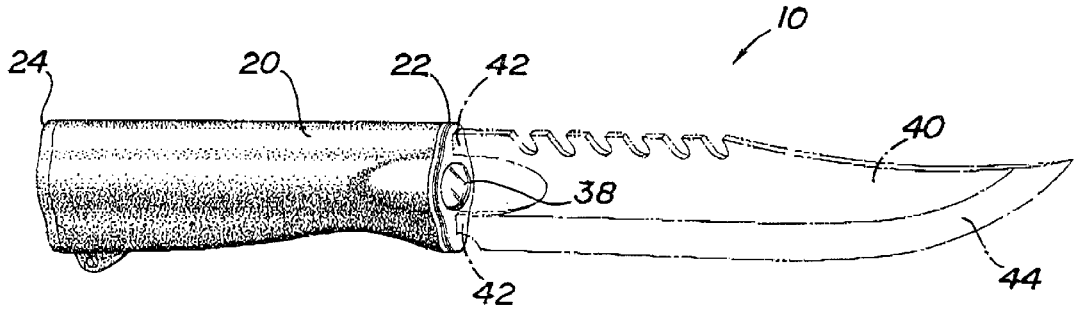
FIG. 7 is a perspective view of a second embodiment of the present invention.
Figure 8:
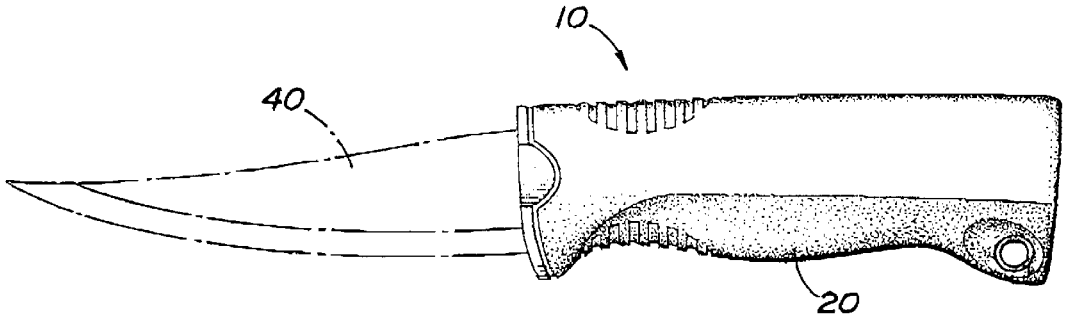
FIG. 8 is a side elevational view of a third embodiment of the present invention.
Figure 9:
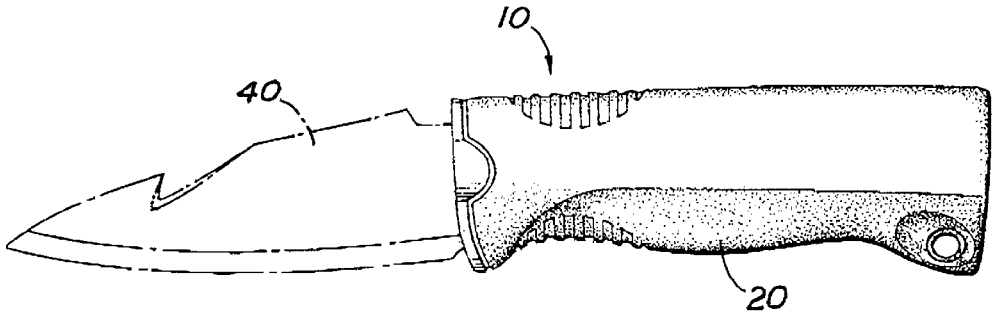
FIG. 9 is a side elevational view of a fourth embodiment of the present invention.

In another embodiment, shown in FIG. 7, the bore may be co-extensive with the length of the handle member 20, such that the first end of the bore creates an aperture 38 through the distal end 22 of the handle member 20. In such embodiments, a light module installed within the bore communicates light directly through the aperture 38 to the blade member 40 and work area. Because the aperture 38 in the distal end 22 of the handle member 20 creates a void in the handle member 20 adjacent the area at which the blade member 40 is connected to the handle member 20, a specially constructed rear end 42 of the blade member 40 may be utilized to anchor the blade member 40 within the handle member 20.

One such construction, also shown in FIG. 7, provides a branched rear end 42 of the blade member 40, such that the separate branches of the rear end 42 are formed into the distal end 22 of the handle member 20 on opposite sides of the bore, such that the branches of the rear end 42 "straddle" the bore and light module. An optically conductive material may be utilized to cover the aperture 38 in such embodiments to prevent damage or soiling of the light module through exposure to the elements or contact with the work environment.

Figure 2A:
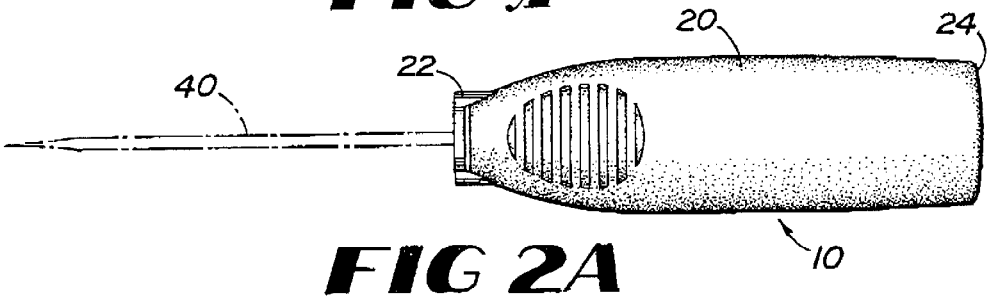
FIG. 2A is a top plan view of FIG. 1.
Figure 2B:
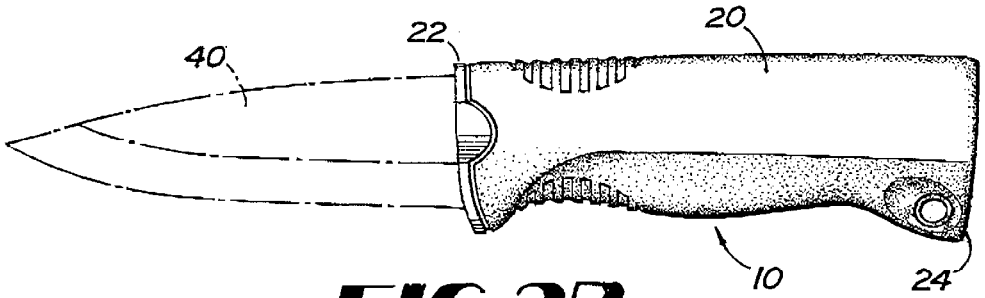
FIG. 2B is a side elevational view of FIG. 1.
Figure 2C:
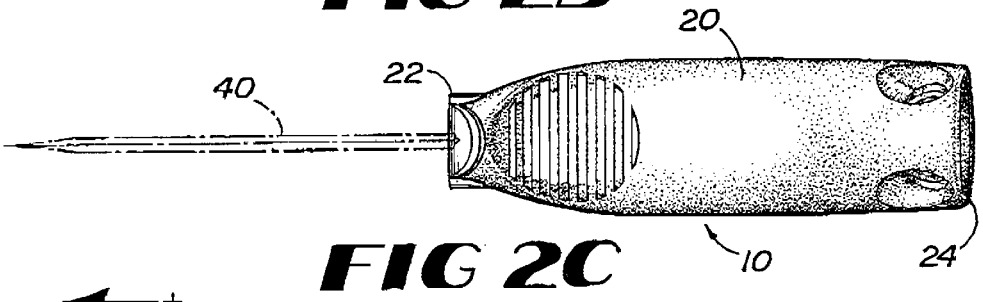
FIG. 2C is a bottom plan view of FIG. 1.
Figure 3:
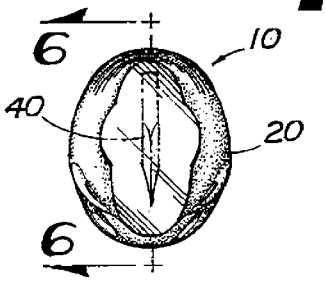
FIG. 3 is a front end view of FIG. 1.
Figure 4:
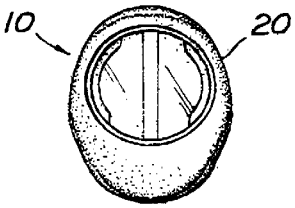
FIG. 4 is a back end view of FIG. 1.
Figure 5:
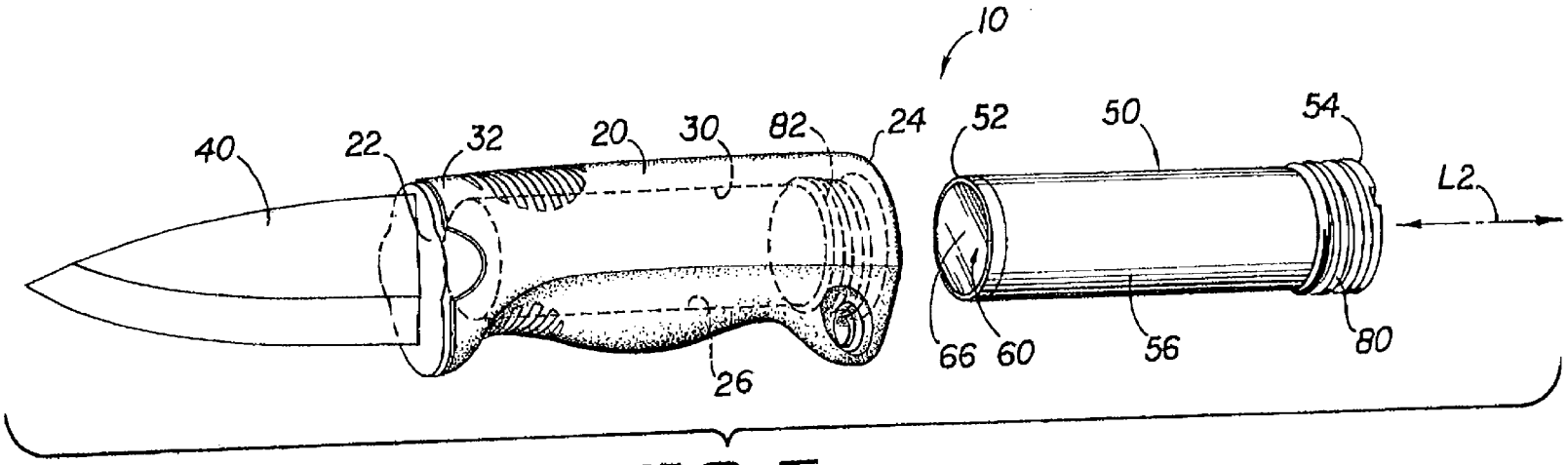
FIG. 5 is an exploded perspective view of FIG. 1.

Referring now to FIGS. 5 and 6, the illuminating means in the preferred embodiment comprises a light module 50, or a flashlight, that has a front end 52, an opposed back end 54, a longitudinal axis L2 and an exterior surface 56. The front end 52 of the light module 50 has a light source 60 capable of producing a beam of light. As best shown in FIG. 6, the light module 50 is of a size to be complementarily received within the bore 26 of the handle member 20 so that the front end 52 is disposed adjacent the first end 28 of the bore 26, the back end 54 is disposed adjacent the proximal end 24 of the handle member 20, and the exterior surface 56 is disposed adjacent the interior surface 30 of the handle member 20. As shown in FIGS. 1, 2, and 6, it is preferred that when the light module 50 is disposed within the bore 26 of the handle member 20, the back end 54 of the light module 50 is substantially flush with the proximal end 24 of the handle member 20. Viewing FIG. 5, one skilled in the art will also appreciate that the light module 50, or flashlight, can be used independently of the handle member 20.

The light module 50 preferably has a circular cross-section with an about a one (1) inch diameter and a length of approximately three and a quarter (3¼) inches. The bore 26 has a volume defined by its circular cross-section and its length, in which the volume is of a dimension to complementarily receive the light module 50 therein, e.g., the length of the bore 26 is substantially the same as that of the light module 50 and the cross-section of the bore 26 is slightly larger than the exterior surface 56 of the light module 50. Thus, the light module 50 can be slid into and out of the bore 26. As one skilled in the art will appreciate, the dimensions of the handle member 20 and the light module 50 can be changed, depending on factors such as the anticipated use of the lighted knife 10, manufacturing considerations, and cost.

Another aspect of the light module 50 is a power means for energizing its light source 60. The power means can be any energy source known in the art that can be used to energize a light source, such as chemical energy or electrical energy. The power means comprises removable batteries 70 in the preferred embodiment that are disposed intermediate the front and back ends 52, 54 of the light module 50. When the power means energizes the light source 60, the light module 50 produces the beam of light. The light source 60 and power means can, alternatively, be integral, such as a chemical compound used as both the light source with an inherent power means.

The power means can also comprise a switching means that selectively energizes and de-energizes the light bulb 62. Referring now to FIG. 6, the switching means preferably comprises an on-off switch 72 disposed at the back end 54 of the light module 50 that is movable between an on position, in which the switching means is positioned to energize the light bulb 62 using the power means, and an off position, in which the power means does not energize the light bulb 62.

The beam of light produced by the energized light source 60 when the light module 50 is disposed within the bore 26 travels from the front end 52 of the light module 50, through the optically conductive portion 32 of the handle member 20, and out of the distal end 22. Accordingly, the light beam illuminates the blade member 40 engaged by the distal end 22 of the handle member 20, allowing the user to see the blade member 40 and work area better. As shown in FIGS. 1, 2A, 2C, 3, 5 and 7, the blade member 40 is disposed in a position laterally centered relative to the length of the light module 50, so that the beam of light produced by the light module 50 is substantially bisected by the blade member 40. That is, an extension of the longitudinal axis L2 of the light module 50 would lie substantially within the plane formed by the blade member 40.

Referring now to FIG. 6, the preferred light source 60 comprises a light bulb 62 disposed adjacent the front end 52 of the light module 50 and a reflective shield 64. The light bulb 62 is preferably recessed within the light module 50 adjacent its front end 52. The reflective shield 64 circumscribes at least a portion of the light bulb 62 so that when the power means energizes the light bulb 62 to produce light, the reflective shield 64 reflects a portion of the light to form the light beam, instead of light propagating in all directions. More specifically, the reflective shield 64 directs the light beam away from the back end 54 of the light module 50 and toward the distal end 22 of the handle member 20 when disposed in the bore 26 thereof. The reflective shield 64 is preferably parabolic in cross-section, which maximizes the efficacy of light around the connecting member 40 and the tool. The parabolic reflective shield 64 also directs the maximum intensity of light in the light beam toward and through the distal end 22 of the handle member 20.

As best shown in FIG. 5, the light source 60 of the light module 50 additionally includes a transparent covering 66 that shields the light bulb 62. The transparent covering 66, for example, encloses the reflective shield 64 and the light bulb 62 to prevent moisture from contacting the light bulb 62 when the light module 50 is used independently of the handle member 20 as a flashlight.

A means for detachably securing the light module 50 within the bore 26 of the handle member 20 is preferably used in the present invention. The detachably securing means allows the light module 50 to be insertable into the bore 26 and removable therefrom. As shown best in FIG. 5, the preferred detachably securing means comprises the back end 54 of the light module 50 and the proximal end 24 of the interior surface 30 of the bore 26 defining complementarily threaded surfaces 80, 82. The light module 50 is inserted into the bore 26 of the handle member 20 and then the two components are twisted relative to each other to be detachably connected. This detachably securing means provides a water resistant connection between the handle member 20 and the light module 50, prevents accidental disengagement of the two components, and hinders accidentally changing the position of the on-off switch 72 of the switching means.

Although not shown, the light module can optionally include a ring member pivotally connected to the back end of the light module for assisting removal of the light module from within the bore. The ring member has a first side and is movable between an extended position, in which the first side of the ring member is spaced apart from the back end of the light module, and a contracted position, in which a portion of the first side of the ring member contacts a portion of the back end of the light module. The ring member can be placed in the extended position and to assist in twisting the light module relative to the handle member.

Other contemplated embodiments of the detachably securing means (not shown) include using snap locks and a quarter-turn engagement between the components. Still another embodiment of the detachable securing means uses two positioning protrusions located adjacent the back end of the light module body that extend slightly above its external surface. The protrusions are movable between a retracted position, in which a top end of the protrusion is substantially aligned and flush with the exterior surface of the light module, and an extended position, in which the top end of the protrusion extends outwardly from the exterior surface of the light module. A biasing means, such as a leaf or other spring, is used to position the protrusions at the normally extended position and to allow movement between the extended and retracted positions. In conjunction, the interior surface of the bore defines an annular groove therein.

In this embodiment using the positioning protrusion detachably securing means, as the light module is axially pushed into the bore, the positioning protrusions are pressed inwardly, against the force of the biasing means, as they traverse through the bore. When the light module slides to the forward most position within the bore, the positioning protrusions align with and are received within the annular groove. The positioning protrusions return to their normally extended position when in registry with the groove to secure the light module within the bore. To remove the light module from within the bore, the ring member is pivotally flipped up to the extended position and then pulled outwardly away from the handle member. As the light module begins to slide out of the bore, the positioning protrusions on the light module retract as they move past the groove and then spring outwardly from the biasing means after passing out of the proximal end of the bore.

A related embodiment to the positioning protrusion detachably securing means uses an annular detent in a selected one of the exterior surface of the light module or the interior surface of the bore. The other of the exterior surface of the light module or the interior surface of the bore provides a complementary annular deformable protrusion, such as an o-ring, which expands into registration with the annular detent, securing the light module within the bore when the light module reaches its installed position.

In this embodiment of the detachably securing means, the light module also preferably includes an aligning protrusion located between the back end of the light module and the two positioning protrusions. Additionally, the bore defines an axially extending slit that starts at the edge of the bore and ends prior to the position of the annular groove. The aligning protrusion slides along the axially extending slit in the wall of the bore, in which the aligning protrusion prevents the light module from rotating within the bore.

Although the presently preferred embodiment uses the removable light module 50, it is also contemplated that the light source may be integrally formed within the handle member 20.

As noted above, the handle member 20 may be formed entirely of a clear material, such as a hardened plastic or other similar polymer. One option with this embodiment is to mold graphics (not shown), such as a trademark design, trademark name, or business name, into the handle member 20. This results in the graphics being edge lit by the light source 60 of the light module 50, which is aesthetically appealing.

As also noted above, the present invention may be used with a plurality of desired shapes of blade members 40, in which any of the desired blade members 40 may be coupled to the distal end 22 of the handle member 20. That is, although there are preferably a plurality of blade members 40 that can be used with the handle member 20, one blade member 40 is used at a time.

The above description has discussed and illustrated a preferred embodiment of the present invention, a lighted knife, in which the blade member is either rigidly mounted or pivotally mounted to the handle member. However, it is also contemplated that the handle member be attached to a component besides a blade member. For example, such a lighted tool is contemplated to include a lighted screwdriver, in which a screwdriver bit or a connecting member capable of accepting such a bit is connected to the handle member. Additionally, a lighted socket wrench is also contemplated, in which a socket is connected to the handle member, either directly or through an intermediate connecting member. As a further example, a lighted barbecue utensil is contemplated, in which a spatula is connected to the handle member. Any other tool or implement that can be useful in a light deficient area may likewise be adapted and substituted for the blade member described herein without departing from the scope of the invention.

Although the present invention has been described with reference to specific details of certain embodiments thereof, it is not intended that such details should be regarded as limitations upon the scope of the invention except as and to the extent that they are included in the accompanying claims.

What is claimed is:

1. A lighted knife, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member;

c. power means for energizing the light source; and d. a blade member engaged with the handle member adjacent the distal end thereof, wherein, when the light module is disposed within the bore, the beam of light produced travels from the front end of the light module and out of the distal end to illuminate at least a portion of the blade member.

2. The lighted knife of claim 1, wherein the blade member is disposed in a position laterally centered relative to the optically conductive portion of the handle member so that the beam of light produced by the light source of the light module is substantially bisected by the blade member after exiting from the front end of the light module.

3. The lighted knife of claim 1, wherein the light source of the light module comprises:

a. a light bulb disposed adjacent the front end of the light module; and b. a reflective shield circumscribing at least a portion of the light bulb so that, when the light bulb produces light, the reflective shield reflects a portion of the light to form a light beam that is directed away from the back end of the light module.

4. The lighted knife of claim 3, wherein the light bulb is recessed within the light module adjacent the first end thereof and wherein the light source of the light module further comprises a transparent covering that shields the light bulb.

5. The lighted knife of claim 1, wherein, when the light module is disposed within the bore of the handle member, the back end of the light module is substantially flush with the proximal end of the handle member.

6. The lighted knife of claim 1, wherein the first end of the bore is spaced apart from the distal end of the handle member, and wherein the portion of the handle member between the first end of the bore and the distal end of the handle member is optically conductive so that light can traverse therethrough.

7. The lighted knife of claim 6, wherein the optically conductive portion of the handle comprises a hardened transparent plastic material.

8. The lighted knife of claim 1, further comprising means for detachably securing the light module within the bore of the handle member so that the light module is insertable into the bore and removable therefrom.

9. The lighted knife of claim 1, wherein the blade member has a rear end and an opposed tip end, the rear end defining at least one cutout passing therethrough.

10. The lighted knife of claim 9, wherein the rear end of the blade member defines two cutouts passing therethrough.

11. The lighted knife of claim 1, wherein the detachably securing means comprises:

a. a threaded surface defined by the exterior of the back end of the light module; and b. a complementarily threaded surface defined by the proximal end of the interior surface of the bore of the handle member, wherein, when the light module is disposed within the bore of the handle member and the light module and handle member are twisted relative to each other, the complementarily threaded surfaces engage one another.

12. A lighted tool, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member, wherein a portion of the handle member is optically conductive between the first end of the bore and the distal end so that light can traverse therethrough;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member;

c. power means for energizing the light source; and d. a blade member engaged with the distal end of the handle member and disposed in a position laterally centered relative to the optically conductive portion of the handle member so that the beam of light produced by the light source of the light module is substantially bisected by the blade member when exiting from the front end of the light module, wherein, when the light module is disposed within the bore, the beam of light produced by the light source travels from the front end of the light module, through the optically conductive portion of the handle member, and out of the distal end.

13. A lighted tool, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member;

c. power means for energizing the light source; and d. means for detachably securing the light module within the bore of the handle member so that the light module is insertable into the bore and removable therefrom, and e. a blade member engaged with the handle member adjacent the distal end thereof, wherein, when the light module is disposed within the bore, the beam of light produced by the light source travels from the front end of the light module and out of the distal end.

14. The lighted tool of claim 13 wherein the first end of the bore is spaced apart from the distal end of the handle member, and wherein the portion of the handle member between the first end of the bore and the distal end of the handle member is optically conductive so that light can traverse therethrough.

15. A lighted tool, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member, wherein the first end of the bore is spaced apart from the distal end of the handle member, and wherein the portion of the handle member between the first end of the bore and the distal end of the handle member is optically conductive so that light can traverse therethrough;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member;

c. power means for energizing the light source; and d. means for detachably securing the light module within the bore of the handle member so that the light module is insertable into the bore and removable therefrom, wherein, when the light module is disposed within the bore, the beam of light produced by the light source travels from the front end of the light module and out of the distal end, and wherein the optically conductive portion of the handle comprises a hardened transparent plastic material.

16. The lighted tool of claim 13, wherein the blade member is disposed in a position laterally centered relative to the optically conductive portion of the handle member so that the beam of light produced by the light source of the light module is substantially bisected by the blade member when exiting from the front end of the light module.

17. A lighted knife, comprising:

a. a handle member having a distal end, a proximal end, and a length extending between the proximal and distal ends, the handle member defining a bore longitudinally extending along at least a portion of the length of a size to receive a light source therein, the bore having a first end and an opposite second end adjacent the proximal end of the handle member and forming an interior surface of the handle member;

b. a blade member engaged with the handle member adjacent the distal end thereof; and c. means, disposed between the first end of the bore and the distal end, for optically directing light produced by the light source so that the light travels through the optically directing means and out of the distal end of the handle member.

18. A lighted tool, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member, wherein a portion of the handle member is optically conductive between the first end of the bore and the distal end so that light can traverse therethrough;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member; and c. power means for energizing the light source, wherein, when the light module is disposed within the bore, the beam of light produced by the light source travels from the front end of the light module, through the optically conductive portion of the handle member, and out of the distal end, and wherein the optically conductive portion of the handle comprises a hardened transparent plastic material.

19. The lighted tool of claim 18, further comprising means for detachably securing the light module within the bore of the handle member so that the light module is insertable into the bore and removable therefrom.

20. A method of illuminating an implement that is longitudinally extending from a distal end of a handle member, the handle member having an opposite proximal end and defining a bore extending at least partially therebetween and at least a portion of the distal end being transparent, comprising the steps of:

a. inserting a light source into the bore of the handle member, the light source being operable within the bore as well as externally and independently of the handle member;

b. detachably securing the light source within the bore; and c. energizing the light source so as to produce a light through the transparent portion of the handle member and onto the implement, wherein the implement comprises a blade member.

21. A lighted tool, comprising:

a. a handle member having a distal end, a proximal end, and a length extending between the proximal and distal ends, the handle member defining a bore longitudinally extending along at least a portion of the length, the bore having a first end and an opposite second end adjacent the proximal end of the handle member and forming an interior surface of the handle member;

b. a unitary light module having a front end, an opposed back end, and an exterior surface, the front end having a light source capable of producing a beam of light, the light module being of a size to be complementarily received within the bore of the handle member so that the front end is disposed adjacent the first end of the bore, the back end is disposed adjacent the proximal end of the handle member, and the exterior surface is disposed adjacent the interior surface of the handle member, the light module being operable within the bore as well as externally and independently of the handle member;

c. power means for energizing the light source; and d. means, disposed between the first end of the bore and the distal end, for optically directing the beam of light produced by the light source of the light module, wherein, when the light module is disposed within the bore, the beam of light travels from the front end of the light module, through the optically directing means, and out of the distal end of the handle member and wherein the optically directing means comprises a hardened transparent plastic material.

22. The lighted tool of claim 21, further comprising means for detachably securing the light module within the bore of the handle member so that the light module is insertable into the bore and removable therefrom.

* * * * *